US009016686B2

(12) United States Patent
Uohashi

(10) Patent No.: US 9,016,686 B2
(45) Date of Patent: Apr. 28, 2015

(54) SHEET FEEDER AND IMAGE FORMING APPARATUS INCLUDING THE SAME

(71) Applicant: KYOCERA Document Solutions Inc., Osaka (JP)

(72) Inventor: Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/258,497

(22) Filed: Apr. 22, 2014

(65) Prior Publication Data

US 2014/0319758 A1 Oct. 30, 2014

(30) Foreign Application Priority Data

Apr. 24, 2013 (JP) ..... 2013-090930

(51) Int. Cl.
*B65H 1/08* (2006.01)
*B65H 1/14* (2006.01)
*B65H 1/04* (2006.01)

(52) U.S. Cl.
CPC ... *B65H 1/14* (2013.01); *B65H 1/04* (2013.01)

(58) Field of Classification Search
USPC ..... 271/147, 164
See application file for complete search history.

(56) References Cited

U.S. PATENT DOCUMENTS 8,123,211 B2 * 2/2012 Akiyama et al. ..... 271/117
8,888,092 B2 * 11/2014 Hayayumi ..... 271/157

FOREIGN PATENT DOCUMENTS

JP 2001-294333 A 10/2001
JP 2005-170575 A 6/2005
JP 2008-265981 A 11/2008

* cited by examiner

*Primary Examiner* — Michael McCullough
(74) *Attorney, Agent, or Firm* — Studebaker & Brackett PC

(57) ABSTRACT

A sheet feeder includes a sheet accommodating section, a sheet loading plate, an operating plate, a sector gear, and a pressing member. The sheet loading plate is turnably supported on a bottom surface of the sheet accommodating section. The operating plate lifts up and down the sheet loading plate. The sector gear transmits drive power from a main body of an image forming apparatus to the operating plate. The pressing member is located at a first location when the sheet loading plate is positioned at the lying down position, and moves to a second location by rotation of the sector gear by a predetermined amount. The first location is a location where the pressing member comes in contact from above with the sheet loading plate at the lying down position, and the second location is a location where the pressing member retreats from the sheet loading plate.

8 Claims, 15 Drawing Sheets

SHEET FEEDER AND IMAGE FORMING APPARATUS INCLUDING THE SAME

INCORPORATION BY REFERENCE

The present application claims priority under 35 U.S.C. §119 to Japanese Patent Application No. 2013-090930, filed Apr. 24, 2013. The contents of this application are incorporated herein by reference in their entirety.

BACKGROUND

The present disclosure relates to sheet feeders used for stocking in advance multiple sheets, such as paper, to be supplied to a device, and image forming apparatuses including such a sheet feeder.

Paper feed cassettes are used for feeding paper, such as cut paper, etc. in image forming apparatuses typified by copiers and printers. A paper feed cassette stocks multiple pieces of non-printed paper in advance and separates and feed it on a sheet-by-sheet basis from the topmost sheet of the paper sheaf stacked in the cassette.

Some paper feed cassette is provided with a sheet loading plate having an upper surface on which paper is to be loaded. The sheet loading plate is supported at its upstream end in a paper feed direction on the inner bottom surface of the cassette main body so that its downstream end in the paper feed direction is turnable as a turning end about the support point as a center. The turning end of the sheet loading plate is lifted upward by a drive means, such as a lift motor or an urging means, such as a spring provided in an image forming apparatus. Thus, the downstream end of the paper loaded on the sheet loading plate can be moved to an appropriate feed position, thereby achieving stable paper feed.

As describe above, the sheet loading plate is supported at its upstream end in the paper feed direction so that its downstream end is turnable as a free end about the support point as a center. Accordingly, the sheet loading plate may turn and float upward by inertia in fitting the paper feed cassette to the image forming apparatus or vibration and/or impact in abutting the paper feed cassette on the insertion point in the rear side of the image forming apparatus. This may cause paper accommodated in the paper feed cassette to flip up toward the downstream side in the insertion direction.

SUMMARY

A sheet feeder according to one mode of the present disclosure is capable of being inserted in and drawn out from a main body of an image forming apparatus in a direction parallel to a sheet feed direction. The sheet feeder includes a sheet accommodating section, a sheet loading plate, an operating plate, an operating plate shaft, a sector gear, and a pressing member. The sheet accommodating section accommodates a sheet. The sheet loading plate is turnably supported at an upstream end part thereof in the sheet feed direction on a bottom surface of the sheet accommodating section, and has an upper surface on which a sheet is loaded. The operating plate lifts up and down the sheet loading plate between a lying down position and a lifted up position in a state in contact from below with a downstream end part of the sheet loading plate in the sheet feed direction, the lying down position being a position where the sheet loading plate lies down along the bottom surface of the sheet accommodating section, and the lifted up position being a position where the sheet loading plate is lifted up by a predetermined angle from the bottom surface of the accommodating section. The operating plate shaft supports the operating plate rotatably to the sheet accommodating section. The sector gear is provided at one end of the operating plate shaft to transmit drive power from the main body to the operating plate. The pressing member is capable of moving between a first location and a second location, the first location being a location where the pressing member comes in contact from above with the sheet loading plate at the lying down position, and the second location being a location where the pressing member retreats from the sheet loading plate to allow the sheet loading plate to be lifted up and down. The pressing member is located at the first location when the sheet loading plate is positioned at the lying down position, and moves from the first location to the second location by rotation of the sector gear by a predetermined amount in a direction where the sheet loading plate is lifted up.

An image forming apparatus according to another mode of the present disclosure is an image forming apparatus including the sheet feeder.

DETAILED DESCRIPTION

Embodiments of the present disclosure will be described in detail below with reference to the accompanying drawings.

Figure 1:
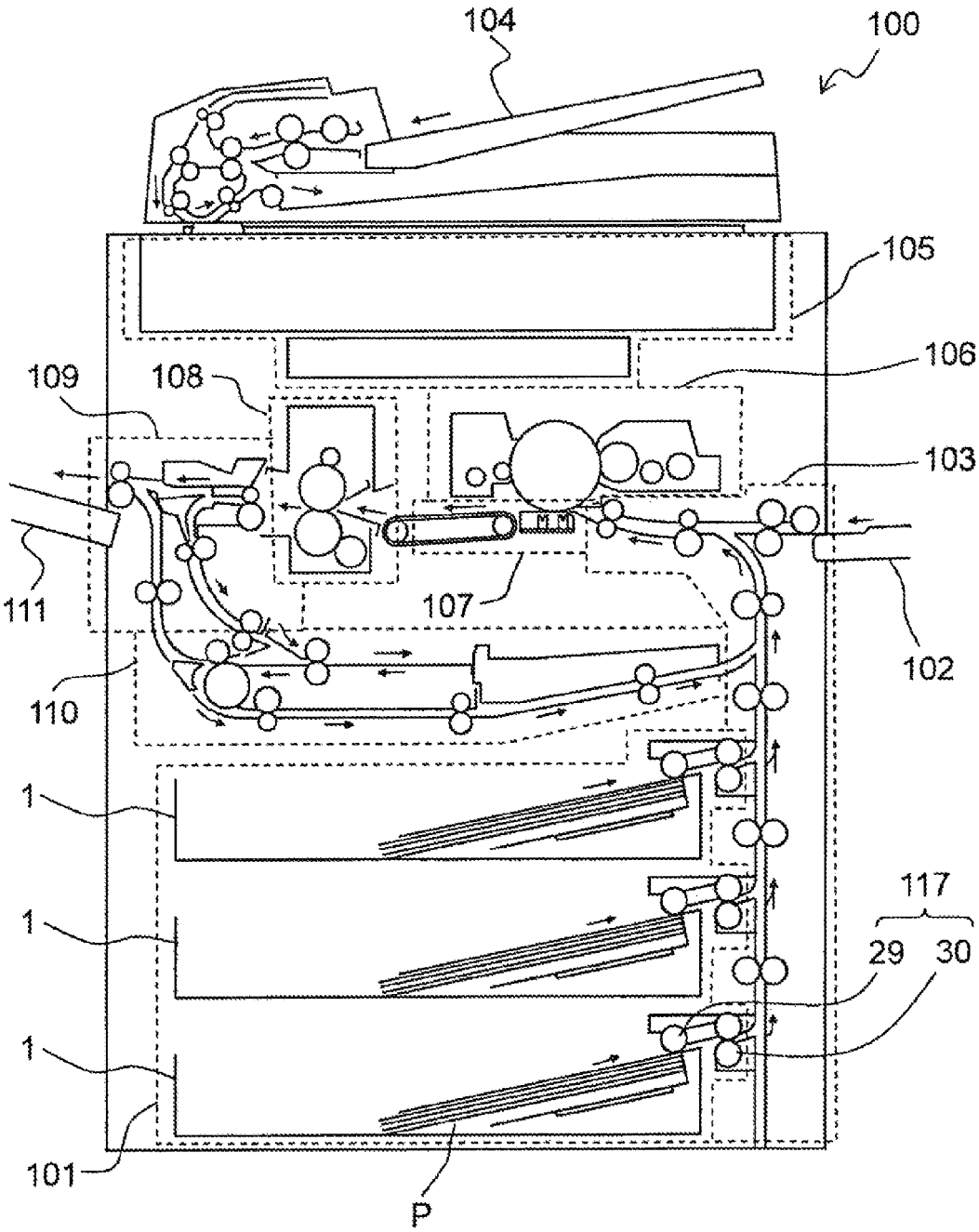
FIG. 1 is a diagram showing an internal configuration of an image forming apparatus including a paper feed cassette according to one embodiment.

FIG. 1 is a diagram showing an internal configuration of an image forming apparatus 100 including a paper feed cassette 1 according to one embodiment. It is noted that the solid arrows in the drawings indicate paper conveyance path and direction.

In FIG. 1, a cassette type paper feed section 101 is arranged in the lower part of the image forming apparatus 100. The cassette type paper feed section 101 includes a plurality (three herein) of paper feed cassettes 1.Z In each paper feed cassette 1, paper P, such as cut paper or the like, before printed is loaded and accommodated, and a paper feeder 117 including a pickup roller 29 and a paper feed roller pair 30 separates and sends the paper on a sheet-by-sheet basis.

A manual paper feed section 102 is provided on the external upper right surface of the image forming apparatus 100. A sheet is loaded on the manual paper feed section 102. The sheet may be paper P with a size or thickness different from that accommodated in the cassette type paper feed section 101, or a sheet, such as a viewgraph, an envelope, a postcard, an invoice, etc., any of which are to be sent on a sheet-by-sheet basis.

A paper conveyance section 103 is provided in the image forming apparatus 100. The paper conveyance section 103 is arranged on the right side, which is the downstream side in a paper feed direction, of the cassette type paper feed section 101 and on the left side, which is the downstream side in the paper feed direction, of the manual paper feed section 102. The paper conveyance section 103 conveys paper P send out from the cassette type paper feed section 101 along the side surface of the main body of the image forming apparatus 100 in the perpendicular direction. Paper P sent out from the manual paper feed section 102 is conveyed in the horizontal direction.

A document feeder 104 is provided on top of the image forming apparatus 100. An image reading section 105 is provided under the document feeder 104. In order for the user to copy a plurality of original documents with a letter, a figure, a pattern, or the like, the original documents may be loaded on the document feeder 104. The document feeder 104 separates and sends out the original documents on sheet-by-sheet basis, so that the image reading section 105 reads each of their image data.

An image forming section 106 and a transfer section 107 are provided downstream of the paper conveyance section 103 in the paper conveyance direction below the image reading section 105. The image forming section 106 forms an electrostatic latent image of a document image on the basis of image data read by the image reading section 105, for example. Then, the formed electrostatic latent image is developed, thereby forming a toner image. Paper P is conveyed from the cassette type paper feed section 101 to the transfer section 107 through the paper conveyance section 103 in synchronization with timing of forming the toner image in the image forming section 106. The transfer section 107 transfers the toner image formed in the image forming section 106 to the paper P.

A fusing section 108 is provided downstream of the transfer section 107. Paper P to which a non-fused toner image is transferred in the transfer section 107 is conveyed to the fusing section 108. Then, the conveyed paper P passes through a nip part formed by a fusing roller pair of a heating roller and a pressure roller so that the non-fused toner image on the paper P is fused to be a permanent image.

An ejection/branch section 109 is provided downstream of the fusing section 108 in the vicinity of the left side surface of the image forming apparatus 100. In simplex printing, paper P sent from the fusing section 108 is ejected onto an exit tray 111 provided on the outer left side surface of the image forming apparatus 100 from the ejection/branch section 109.

A duplex printing unit 110 is provided below a region ranging from the image forming section 106 to the ejection/branch section 109 and above the cassette type paper feed section 101. In duplex printing, paper P sent from the fusing section 108 is sent to the duplex printing unit 110 through the ejection/branch section 109. The paper P sent to the duplex printing unit 110 is switched back to be turned over and is conveyed again through the paper conveyance section 103 to the transfer section 107 with its surface not subjected to image formation facing upward.

Figure 2:
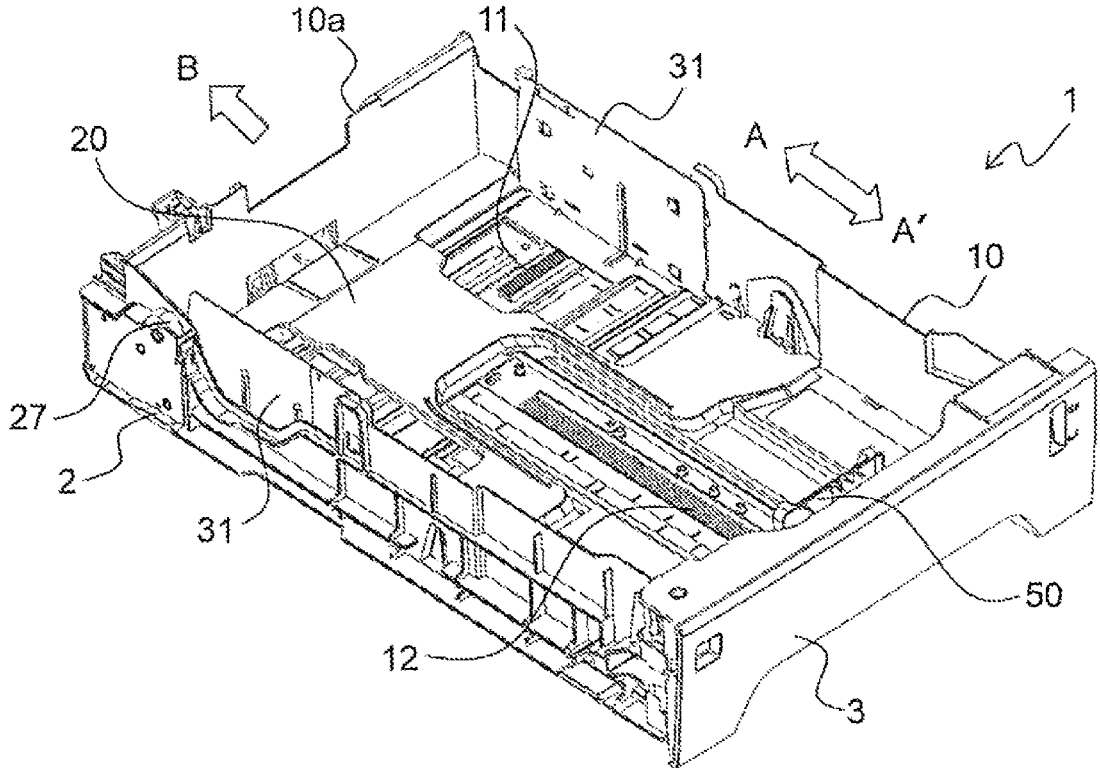
FIG. 2 is a perspective view of the paper feed cassette as viewed from above front according to one embodiment.
Figure 3:
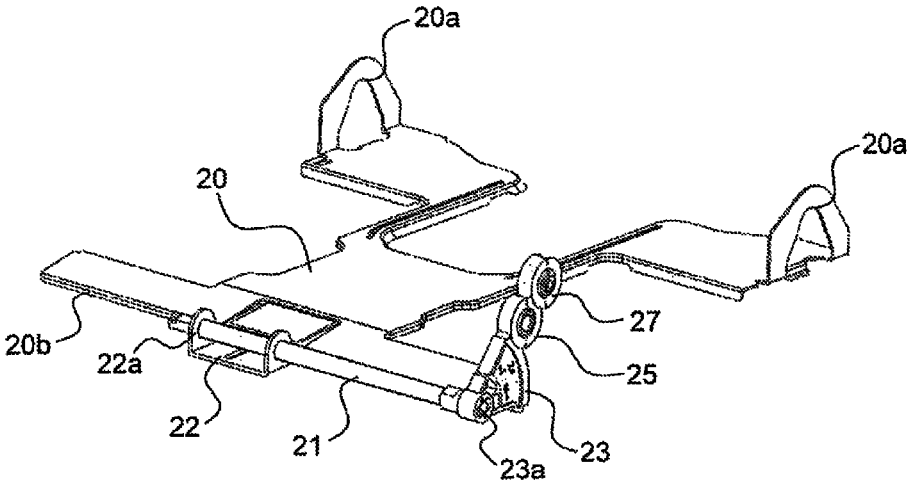
FIG. 3 is the first perspective view showing a lifting mechanism of a sheet loading plate according to one embodiment.
Figure 4:
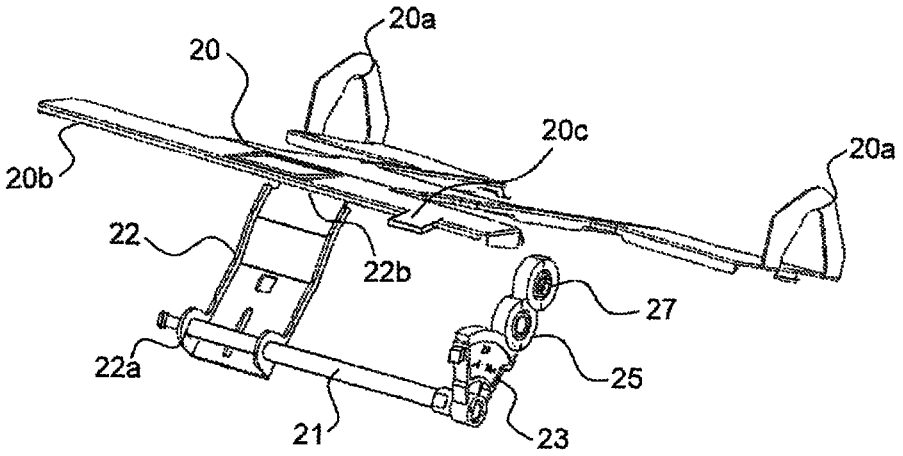
FIG. 4 is the second perspective view showing the lifting mechanism of the sheet loading plate according to one embodiment.

With reference to FIGS. 2-4 in addition to FIG. 1, a detailed configuration of each paper feed cassettes 1 according to the present disclosure will described next. FIG. 2 is a perspective view of the paper feed cassette 1 as viewed from above front according to the present embodiment. FIG. 3 is the first perspective view showing a lifting mechanism of a sheet loading plate 20 according to the present embodiment. The first perspective view shows a state in which a free end portion 20*b* of the sheet loading plate 20 is lifted down to the lowest level.

The paper feed cassette 1 in FIG. 2 is accommodated in the cassette type paper feed section 101 of the image forming apparatus 100 shown in FIG. 1. The paper feed cassette 1 is inserted in the cassette type paper feed section 101 in a manner that a rail portion 2 formed on the side surface of a cassette main body 10 is engaged with a rail (not shown) formed inside the image forming apparatus 100, and the paper feed cassette 1 is slid horizontally in the direction indicated by the arrow AA' in FIG. 2.

The cassette main body 10 is in a flat box shape with its top opened and accommodates paper by loading the paper from above. In the interior of the image forming apparatus 100, the paper feeder 117 (see FIG. 1) is provided above each paper feed cassette 1 and outside a wall 10*a* that is located downstream of each cassette main body 10 in the insertion direction. Paper is supplied in the direction indicated by the arrow B in FIG. 2. In other words, the direction indicated by the arrow B is a direction in which paper P is fed (hereinafter referred to as a paper feed direction or a sheet feed direction). The paper feed cassette 1 is capable of being inserted in and drawn out from the main body of the image forming apparatus 100 in a direction parallel to the paper feed direction. An exterior cover 3 is formed integrally with the front surface of the cassette main body 10. The exterior cover 3 forms a lower part of the housing of the image forming apparatus 100.

A sheet loading plate 20 is provided on the inner bottom surface of the cassette main body 10. Paper is loaded on the sheet loading plate 20. The sheet loading plate 20 and its lifting mechanism will be described later.

A pair of side edge guides 31 is provided in the interior of the cassette main body 10 to stand in the paper feed direction. The side edge guides 31 position paper in the width direction in a manner that they come in contact with the side surfaces of a paper sheaf from the opposite sides in the paper width direction, which is orthogonal to the paper feed direction, so as to make the paper positioned at a paper feed position where the paper feeder 117 feeds the paper. The side edge guides 31 are movable along a side edge guide moving groove 11 extending in the paper width direction in the inner bottom surface of the cassette main body 10.

A groove engaging portion (not shown) is provided at the lower part of each side edge guide 31. Engagement of the groove engaging portion with the side edge guide moving groove 11 formed in the inner bottom surface of the cassette main body 10 can prevent the side edge guides 31 from falling off from the cassette main body 10. It is noted that the pair of side edge guides 31, which comes in contact with the side surfaces of a paper sheaf from the opposite sides in the paper width direction, is configured such that movement of one of the guides 31 accompanies movement of the other by an interlink mechanism (not shown) provided below them. At that time, the pair of side edge guides 31 moves in a bilaterally symmetrical manner about the center line of paper in the width direction.

A rear edge guide 50 is provided upstream in the paper feed direction in the interior of the cassette main body 10. The rear edge guide 50 positions paper in the paper feed direction in a manner that it comes in contact with the side surface of a paper sheaf from the upstream side in the paper feed direction so as to make the paper positioned at the paper feed position where the paper feeder 117 feeds the paper. The rear edge guide 50 is movable along a rear edge guide moving groove 12 extending in the paper feed direction in the inner bottom surface of the cassette main body 10. Similarly to the side edge guides 31, engagement of a groove engaging portion (not shown) provided at the lower part of the rear edge guide 50 with the rear edge guide moving groove 12 can prevent the rear edge guide 50 from falling off from the cassette main body 10.

As shown in FIG. 3, the sheet loading plate 20 is supported at its upstream ends in the paper feed direction as turning pivots 20*a* on the inner bottom surface of the cassette main body 10 so that its downstream end portion in the paper feed direction is vertically turnable as a free end portion 20*b*. The sheet loading plate 20 is a plate-shaped member. A notch is formed in each region of the sheet loading plate 20 where the side edge guides 31 and the rear edge guide 50 move. A protruding piece 20*c*, which comes in contact with a pressing member 33 (see FIG. 6), is formed at the free end portion 20*b* of the sheet loading plate 20.

An operating plate drive shaft 21 is arranged below the free end portion 20*b* of the sheet loading plate 20. The operating plate drive shaft 21 is rotatably held by a bearing (not shown) formed on the inner bottom surface of the cassette main body 10. One end part of the operating plate drive shaft 21 passes through a fixing hole 22*a* of an operating plate 22 to fix the operating plate 22 to the operating plate drive shaft 21. The operating plate 22 is arranged to face a part of the reverse surface of the sheet loading plate 20 which is substantially the central part in the paper width direction.

A fan-shaped gear (sector gear) 23 is connected to the other end of the operating plate drive shaft 21. The fan-shaped gar 23 is connected to a drive input gear 27 through an idler gear 25. As shown in FIG. 2, a part of the drive input gear 27 is exposed from the cassette main body 10. When the paper feed cassette 1 is inserted to the image forming apparatus 100, the drive input gear 27 is connected to a drive output gear (not shown) in the main body of the image forming apparatus 100.

It is noted that FIG. 3 shows the state in which the paper feed cassette 1 is not inserted in the image forming apparatus 100, so that the drive input gear 27 is not connected to the drive output gear in the main body of the image forming apparatus 100. In this state, the operating plate 22 lies down along the inner bottom surface of the cassette main body 10. Accordingly, the free end portion 20*b* of the sheet loading plate 20 is lifted down to the lowest level.

Figure 5:
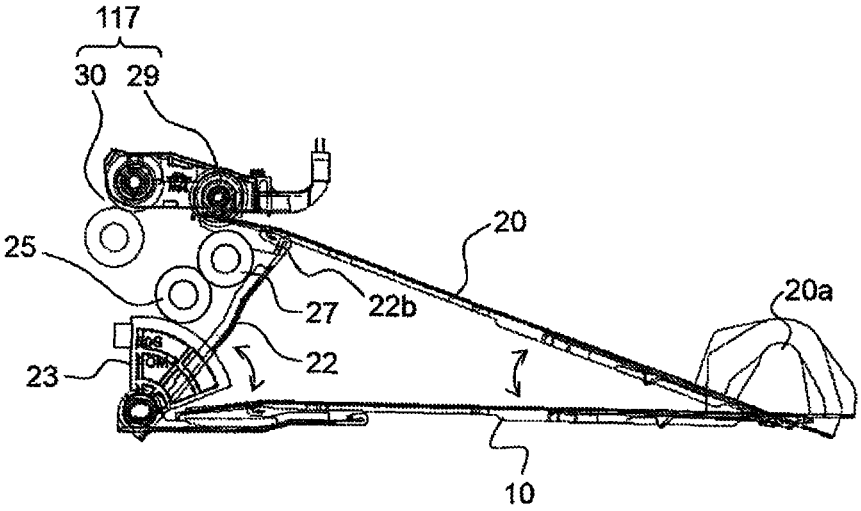
FIG. 5 is a side view showing the lifting mechanism of the sheet loading plate according to one embodiment.

FIGS. 4 and 5 are the second perspective view and a side view, respectively, showing a lifting mechanism of the sheet loading plate 20 according to the present embodiment. The second perspective view and the side view of FIG. 5 show a state in which the operating plate 22 lifts up the free end portion 20*b* of the sheet loading plate 20. When the drive output gear rotates in a state in which the paper feed cassette 1 is inserted in the image forming apparatus 100, the drive power is transmitted to the operating plate drive shaft 21 through the drive input gear 27, the idler gear 25, and the fan-shaped gear 23. Turning the operating plate 22 in the anticlockwise direction in FIG. 5 causes a turning side edge 22*b* of the operating plate 22 to slide along the reverse surface of the sheet loading plate 20, thereby raising and lifting up the free end portion 20*b* of the sheet loading plate 20.

Thus, the topmost paper loaded on the sheet loading plate 20 comes in contact with the pickup roller 29 of the paper feeder 117 provided in the image forming apparatus 100. Then, the paper feed roller pair 30 of a feed roller 30*a* and a retard roller 30*b* separates the paper sheet by sheet and sends it to the paper conveyance section 103 from the paper feed cassette 1.

As the paper loaded on the sheet loading plate 20 is supplied, the amount of rotation of the drive output gear is increased. This increases the amount of turning of the operating plate 22 to increase the angle between the inner bottom surface of the cassette main body 10 and the operating plate 22. When all the paper loaded on the sheet loading plate 20 is supplied, the operating plate 22 is lifted by a predetermined angle from the inner bottom surface of the cassette main body 10, so that the free end portion 20*b* of the sheet loading plate 20 is lifted up to the highest level.

Figure 6A:
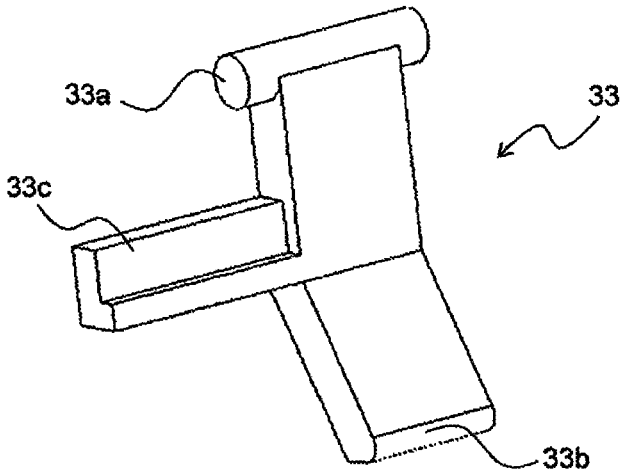
FIG. 6A is a perspective view of a pressing member as viewed from front according to one embodiment.
Figure 6B:
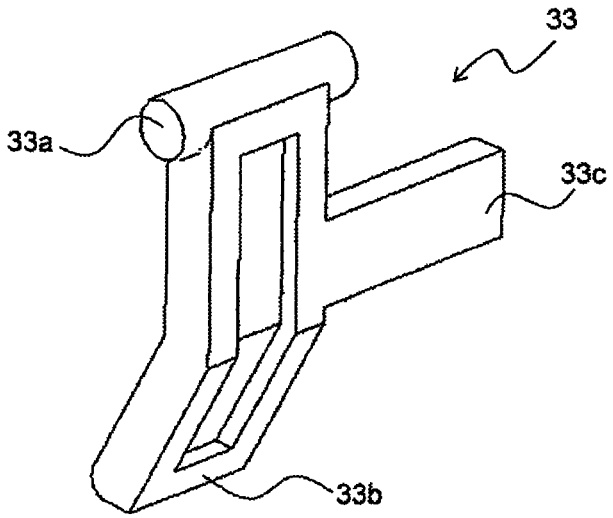
FIG. 6B is a perspective view of the pressing member as viewed from back according to one embodiment.
Figure 7A:
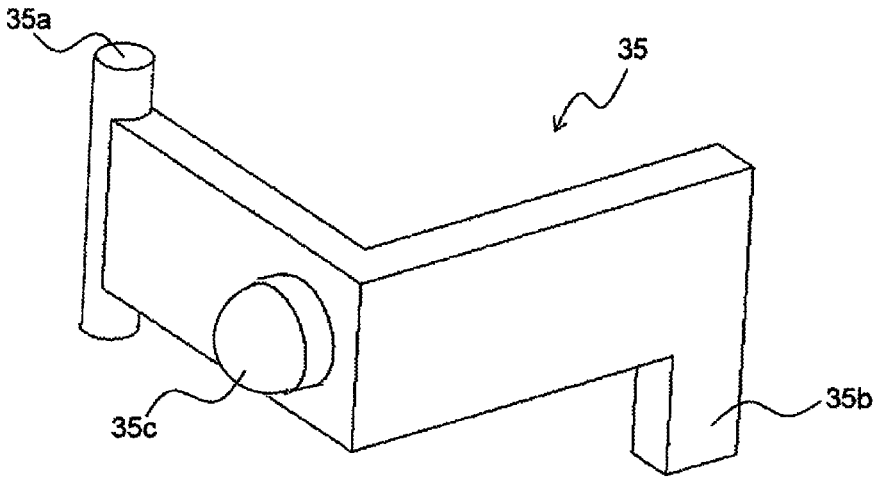
FIG. 7A is a perspective view of a link member as viewed from front according to one embodiment.
Figure 7B:
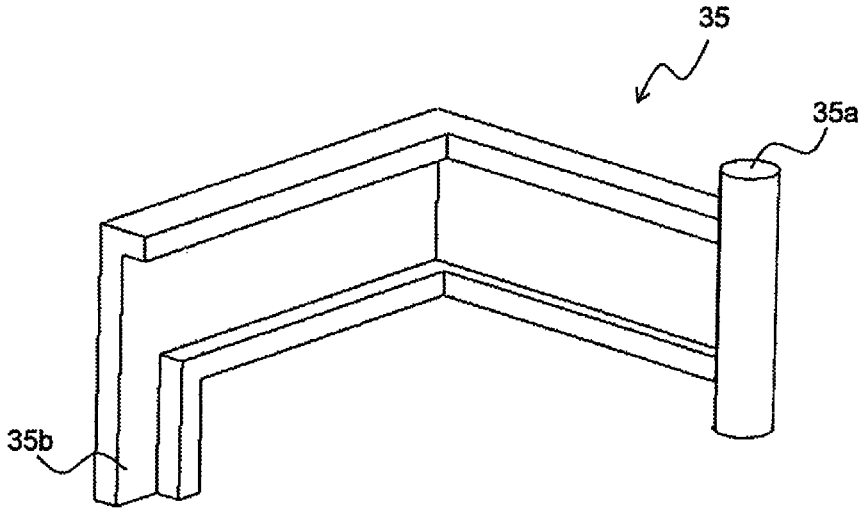
FIG. 7B is a perspective view of the link member as viewed from back according to one embodiment.

Description will be made next about a fixing mechanism of the sheet loading plate 20 in the paper feed cassette 1 according to the present embodiment. FIG. 6A is a perspective view of the pressing member 33 as viewed from front according to the present embodiment. FIG. 6B is a perspective view of the pressing member 33 as viewed from back according to the present embodiment. FIG. 7A is a perspective view of a link member 35 as viewed from front according to the present embodiment. FIG. 7B is a perspective view of the link member 35 as viewed from back according to the present embodiment.

The pressing member 33 is a resin member having a shape in which a plate-like member is bent at its central part in its longitudinal direction. The bent angle, that is, an angle formed between the plane from the bent part to one end of the pressing member 33 and the plane from the bent part to the other end of the pressing member 33 may be larger than 90 degrees, for example. At one end of the pressing member 33, a first swing shaft 33*a* is formed which is swingably supported on the cassette main body 10. On the other hand, a restricting portion 33*b* is formed at a swing end of the pressing member 33, which is located opposite to the first swing shaft 33*a*. The restricting portion 33*b* abuts on the protruding piece 20*c* (see FIG. 4) of the sheet loading plate 20 to restrict upward movement of the sheet loading plate 20. Further, a first engaging portion 33*c* protruding in parallel to the first swing shaft 33*a* is formed at a part of the side surface of the pressing member 33 which is located aside from the bent part of the pressing member 33 toward the first swing shaft 33*a*.

The link member 35 is a resin member having a shape in which a plate-like member is bent at its central part in its longitudinal direction. The bent angle, that is, an angle formed between the plane from the bent part to one end of the link member 35 and the plane from the bent part to the other end of the link member 35 may be 90 degrees, for example. That is, the link member 35 is a member in an L shape when viewed from a side. At one end of the link member 35, a second swing shaft 35*a* is formed which is swingably supported on the cassette main body 10. On the other hand, a second engaging portion 35*b* protruding in parallel to the second swing shaft 35*a* is formed at a swing end of the link member 35, which is located opposite to the second swing shaft 35*a*. When the link member 35 swings about the second swing shaft 35*a* of the link member 35 as a swing pivot, the second engaging portion 35*b* is allowed to engage with the first engaging portion 33*c* of the pressing member 33. Further, a hemispherical protrusion 35*c* protrudes in the direction opposite to a direction where the link member 35 is bent from a part of the side surface of the link member 35 which is located aside from the bent part toward the second swing shaft 35*a*.

Figure 8:
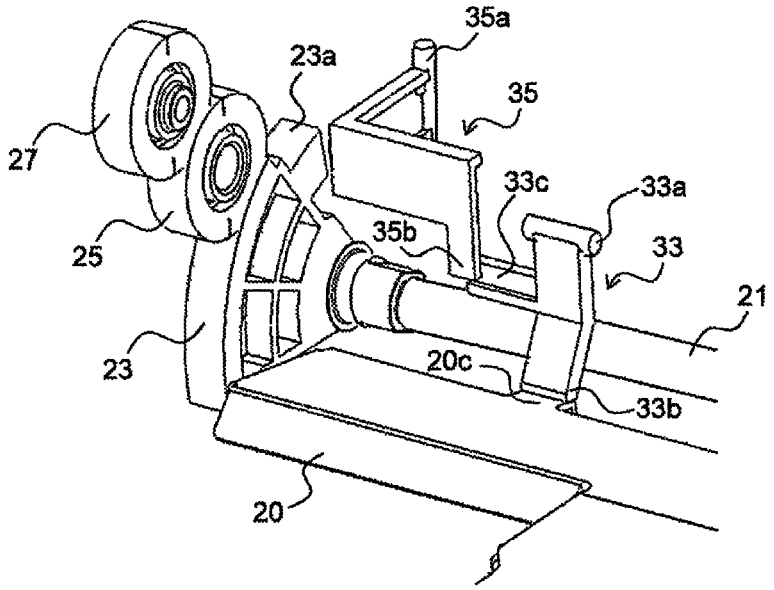
FIG. 8 is a perspective view of a fixing mechanism of the sheet loading plate as viewed from the upstream side in a paper feed direction according to one embodiment.
Figure 9:
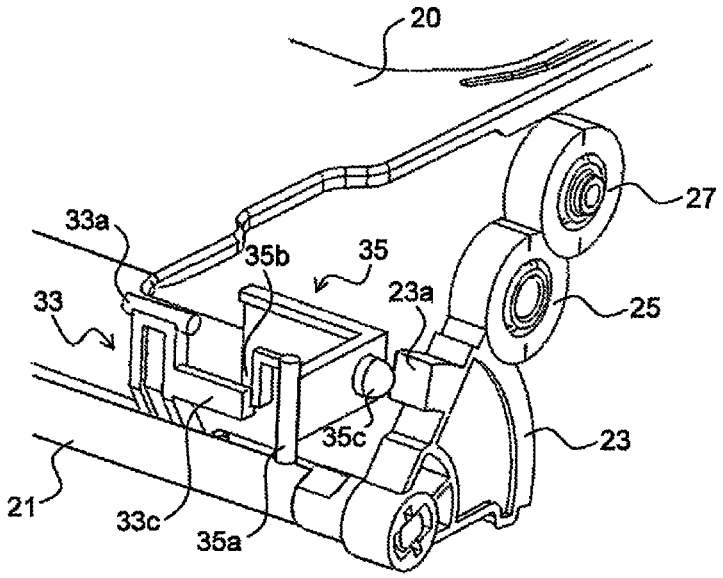
FIG. 9 is a perspective view of the fixing mechanism of the sheet loading plate as viewed from the downstream side in the paper feed direction according to one embodiment.
Figure 10:
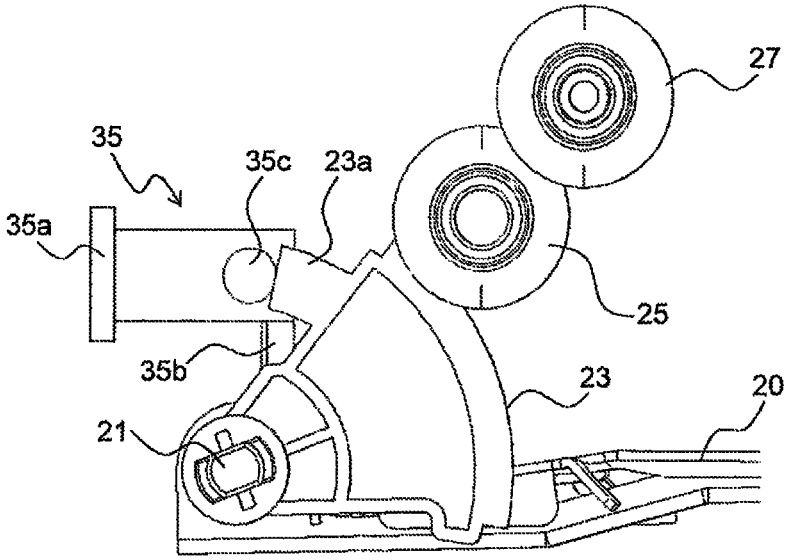
FIG. 10 is a side view of the fixing mechanism of the sheet loading plate according to one embodiment.
Figure 11:
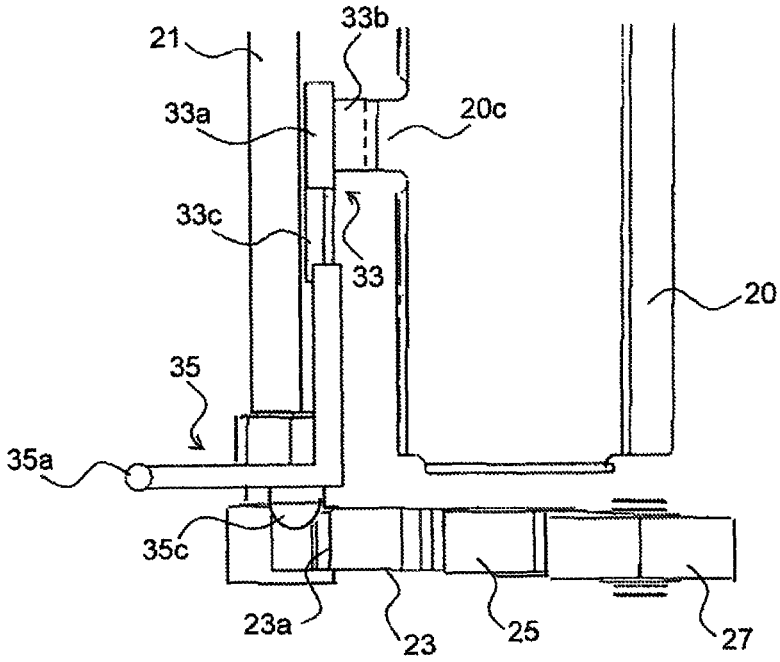
FIG. 11 is a plan view of the fixing mechanism of the sheet loading plate as viewed from above according to one embodiment.
Figure 12:
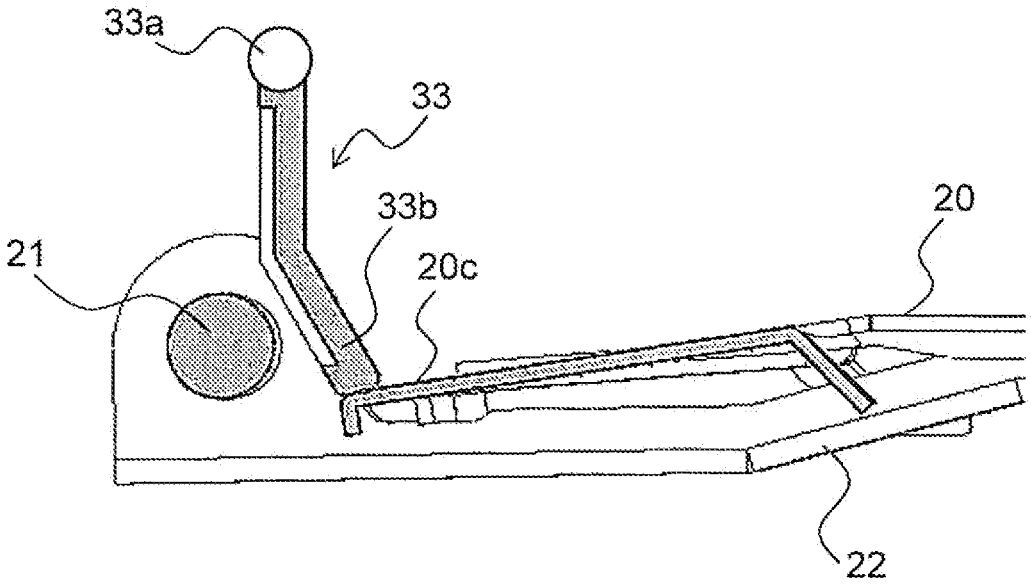
FIG. 12 is a partial cross sectional view showing the relationship between the pressing member and the sheet loading plate in FIGS. 10 and 11.

FIGS. 8 and 9 are perspective views of the fixing mechanism of the sheet loading plate 22 as viewed from the upstream and downstream sides in the paper feed direction, respectively, according to the present embodiment. FIG. 10 is a side view of the fixing mechanism of the sheet loading plate 20 according to the present embodiment. FIG. 11 is a plan view of the fixing mechanism of the sheet loading plate 20 as viewed from above according to one embodiment. FIG. 12 is a partial cross sectional view showing the relationship between the pressing member 33 and the sheet loading plate 20 in FIGS. 10 and 11. FIGS. 8-12 show the state in which the paper feed cassette 1 is not inserted to the main body of the image forming apparatus 100, and the sheet loading plate 20 is fixed. Further, a wall 10*a* of the cassette main body 10, which extends vertically in FIG. 11, stands between the sheet loading plate 20 and the link member 35 to define the interior and exterior of the cassette main body 10. A notch (not shown) is formed vertically in the wall 10*a* to avoid interference with the protruding piece 20*c* in lifting up of the sheet loading plate 20. In this state, the operating plate 22 lies down along the inner bottom surface of the cassette main body 10, so that the free end part 20*b* of the sheet loading plate 20 is lifted down to the lowest point.

As shown in FIGS. 8 and 12, the pressing member 33 is supported so as to be vertically swingable about the first swing shaft 33*a* extending in the horizontal direction as a pivot relative to the cassette main body 10. The restricting portion 33*b* of the pressing member 33 is arranged at a location (hereinafter referred to as a first location) where it comes in contact from above with the protruding piece 20*c* of the sheet loading plate 20 which protrudes outward through the notch formed in the wall 10*a*, thereby restricting upward turning of the free end portion 20*b* of the sheet loading plate 20.

The link member 35 is supported so as to be swingable in the horizontal direction about the perpendicularly extending second swing shaft 35*a* as a pivot relative to the cassette main body 10. The second engaging portion 35*b* of the link member 35 is engaged with the first engaging portion 33*c* of the pressing member 33 from the upstream side in the paper feed direction.

When the paper feed cassette 1, in which a paper sheaf is loaded on the sheet loading plate 20, is inserted up to a predetermined point in the image forming apparatus 100 in a state in which the image forming apparatus 100 is turned on, the drive input gear 27 meshes with the drive output gear in the main body of the image forming apparatus 100, so that the drive power is transmittable to the operating plate drive shaft 21 through the drive input gear 27, the idler gear 25, and the fan-shaped gear 23. In this state, the restricting portion 33*b* of the pressing member 33 is in contact with the protruding piece 20*c* so that the sheet loading plate 20 is in a fixed state. Accordingly, the sheet loading plate 20 will not float up by inertia or impact by insertion of the paper feed cassette 1.

Figure 13:
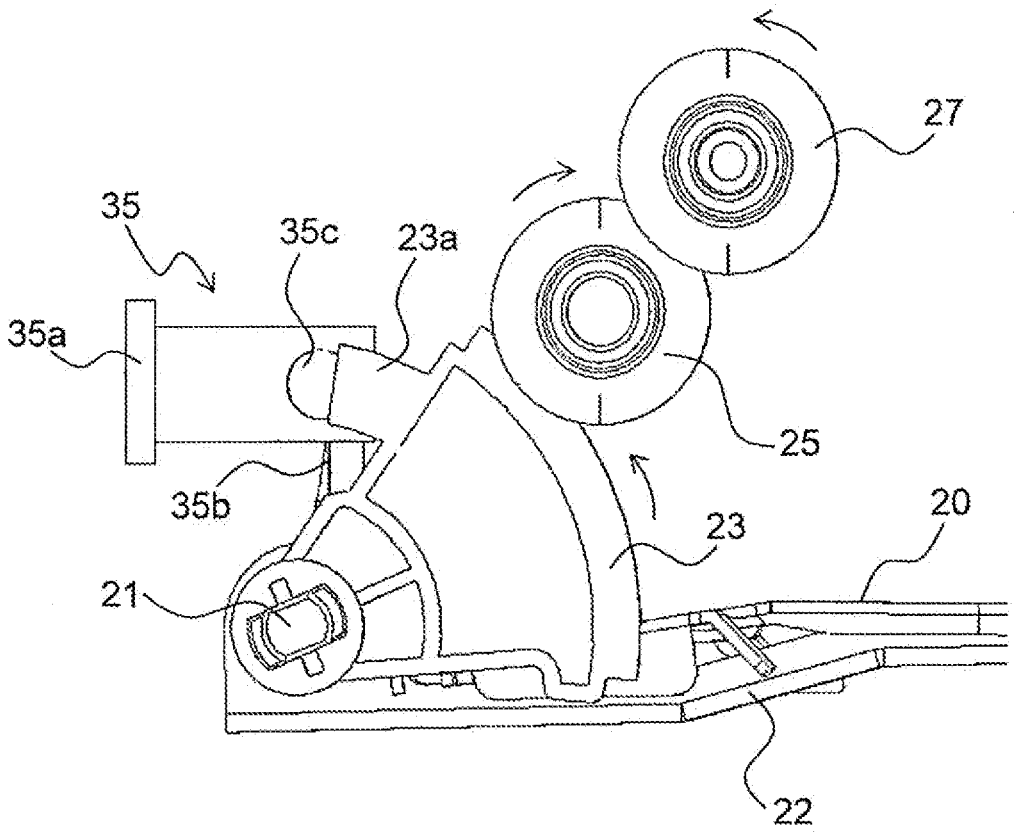
FIG. 13 is a side view of the fixing mechanism of the sheet loading plate according to one embodiment.
Figure 14:
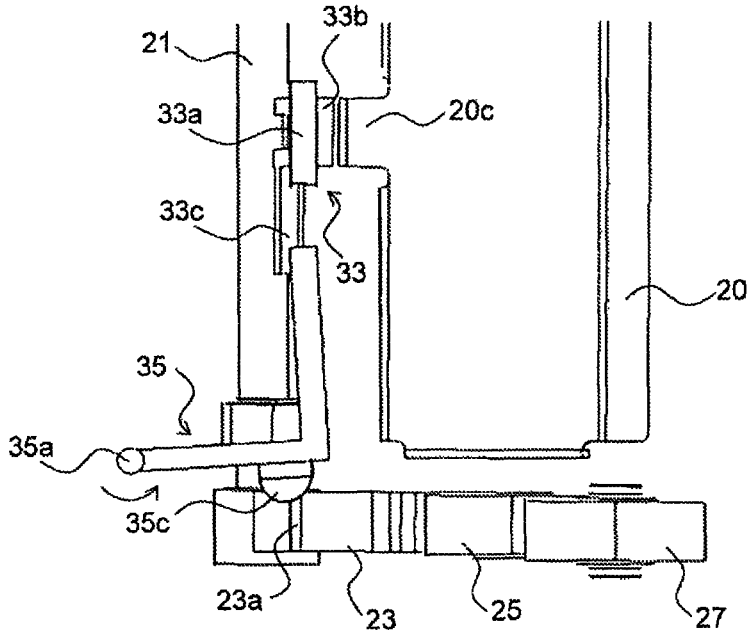
FIG. 14 is a plan view of the fixing mechanism of the sheet loading plate as viewed from above according to one embodiment.
Figure 15:
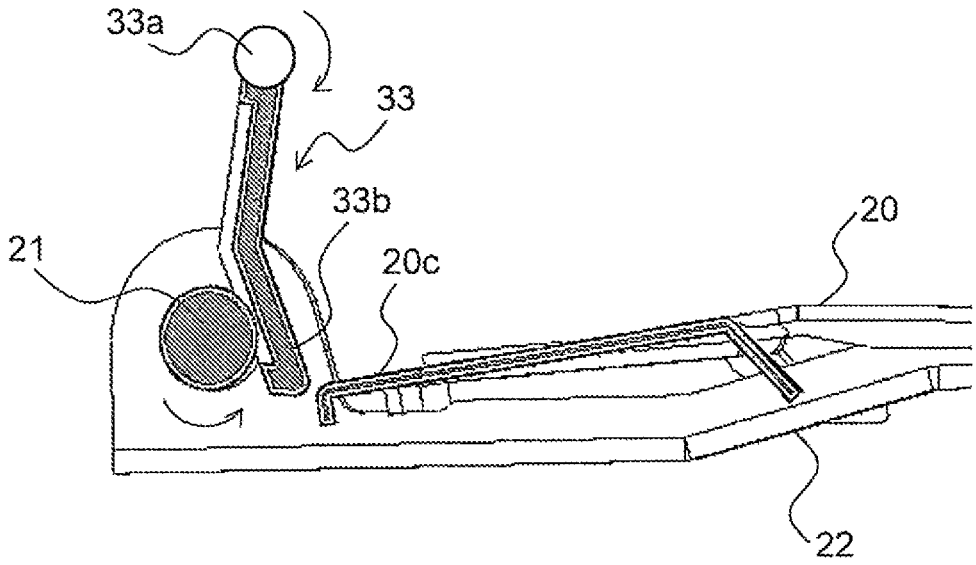
FIG. 15 is a partial cross sectional view showing the relationship between the pressing member and the sheet loading plate in FIGS. 13 and 14.

FIG. 13 is a side view of the fixing mechanism of the sheet loading plate 20 according to the present embodiment. FIG. 14 is a plan view of the fixing mechanism of the sheet loading plate 20 as viewed from above according to one embodiment. FIGS. 13 and 14 each show a state in which the fixed state of the sheet loading plate 20 is released. FIG. 15 is a partial cross sectional view showing the relationship between the pressing member 33 and the sheet loading plate 20 in FIGS. 13 and 14. When a controller (not shown) in the image forming apparatus 100 detects insertion of the paper feed cassette 1, a motor (not shown) is driven to rotate the drive output gear in the main body of the image forming apparatus 100. Driving and rotation of the drive output gear starts rotation of the drive input gear 27 in the anticlockwise direction in FIG. 13. This accompanies rotation of the idler gear 25 and the fan-shaped gear 23 in the clockwise and anticlockwise directions, respectively.

Rotation of the fan-shaped gear 23 causes a protruding portion 23*a* formed on the side surface of the fan-shaped gear 23 to push the protrusion 35*c* of the link member 35 from the side. The fan-shaped gear 23 continues rotating, while its protruding portion 23*a* slides on the semispherical surface (sliding surface) of the protrusion 35*c*, so that the protrusion 35*c* rides on the protruding portion 23*a* and moves in a direction away from the fan-shaped gear 23 (upward in FIG. 14). As a result, the link member 35 swings in the anticlockwise direction in FIG. 14 about the second swing shaft 35*a* as a pivot.

Swing of the link member 35 causes the second engaging portion 35*b* to push the first engaging portion 33*c* of the pressing member 33 from the upstream side in the paper feed direction (rightward in FIG. 14). As a result, the pressing member 33 swings in the clockwise direction in FIG. 15 about the first swing shaft 33*a* as a pivot. Thus, the pressing member 33 is positioned at a location (hereinafter referred to as a second location) where the restricting portion 33*b* having been in contact with the protruding piece 20*c* retreats toward the operating plate drive shaft 21, as shown in FIG. 15. As a result, the sheet loading plate 20 is allowed to turn upward, thereby releasing the fixed state.

Further, rotation of the fan-shaped gear 23 causes the operating plate drive shaft 21 connected to the fan-shaped gear 23 to rotate in the anticlockwise direction in FIG. 15. Thus, the operating plate 22 fixed to the operating plate drive shaft 21 turns upward by a predetermined angle to lift the free end portion 20*b* of the sheet loading plate 20. Then, the topmost paper of the paper sheaf loaded on the sheet loading plate 20 comes in contact with the pickup roller 29 of the paper feeder 117, thereby completing preparation of paper feed automatically.

With the configuration according to the present embodiment, the sheet loading plate 20 is fixed in a lying down position until the paper feed cassette 1 is inserted up to the predetermined position of the image forming apparatus 100. When the drive power is input to the drive input gear 27 so that the gears (drive 27, idler gear 25, or fan-shaped gear 23) rotates by respective predetermined amounts in the direction where the sheet loading plate 20 is lifted up after the paper feed cassette 1 is inserted up to the predetermined position of the image forming apparatus 100, the fixed state of the sheet loading plate 20 can be released automatically. Accordingly, according to the present embodiment, the sheet loading plate 20 can be prevented from floating up by inertia or impact by insertion of the paper feed cassette 1, thereby effectively preventing displacement and flip up of paper accommodated in the cassette main body.

Moreover, provision of the link member 35 between the fan-shaped gear 23 and the pressing member 33 can convert the rotation and drive force of the fan-shaped gear 23 to a pressing force in the paper feed direction. Thus, the pressing force of the link member 35 can smoothly move the pressing member 33 to the first location to the second location.

The present disclosure is not limited to the above embodiment. Besides, various alterations can be made within the scope not departing from the subject matter of the present disclosure. In one example, the first engaging portion 33*c* of the pressing member 33 engages with the second engaging portion 35*b* of the link member 35 in a separable manner in the above embodiment. However, the first engaging portion 33*c* is joined in advance to the second engaging portion 35*b* in a turnable manner.

Further, the two members of the pressing member 33 and the link member 35 are used for setting and releasing of the fixed state of the sheet loading plate 20 in the above embodiment. However, setting and releasing of the fixed state of the sheet loading plate 20 may be done by a single member. In one example, the pressing member 33 may be allowed to swing in a manner that the pressing member 33 is arranged near the fan-shaped gear 23 without the link member 35 so that the protruding portion 23*a* of the fan-shaped gear 23 directly pushes the first engaging portion 33*c* of the pressing member 33.

Moreover, in the above embodiment, the link member 35 swings in a direction where it moves away from the fan-shaped gear 23 in a manner that the hemispherical surface of the protrusion 35*c* formed on the link member 35 rides on the protruding portion 23*a* of the fan-shaped gear 23. However, the shape of the protrusion 35*c* is not limited to the hemispherical shape. The protrusion 35*c* is required only to have a sliding surface along which the protruding portion 23*a* can smoothly slide, such as curved surface, inclined surface, etc. Alternatively, the sliding surface may be formed on the protruding portion 23*a*.

Still further, the operating plate 22 is connected to the fan-shaped gear 23 through the operating plate drive shaft 21 in the above embodiment. In place of the operating plate drive shaft 21, a metal plate or the like bent in a rectangular C shape may be used instead, for example. Or, a circular gear may be used in place of the fan-shaped gear 23. In the case using the circular gear, a protrusion to push the link member 35 is formed on a flat part of the circular gear where no gear tooth is formed, for example. In addition, any of various types of sheets besides paper, such as a viewgraph, a label sheet, etc. may be accommodated in the paper feed cassette 1.

What is claimed is:

1. A sheet feeder, which is capable of being inserted in and drawn out from a main body of an image forming apparatus in a direction parallel to a sheet feed direction, the sheet feeder comprising:

a sheet accommodating section configured to accommodate a sheet;

a sheet loading plate which is turnably supported at an upstream end part thereof in the sheet feed direction on a bottom surface of the sheet accommodating section and which has an upper surface on which a sheet is loaded;

an operating plate configured to lift up and down the sheet loading plate between a lying down position and a lifted up position in a state in contact from below with a downstream end part of the sheet loading plate in the sheet feed direction, the lying down position being a position where the sheet loading plate lies down along the bottom surface of the sheet accommodating section, and the lifted up position being a position where the sheet loading plate is lifted up by a predetermined angle from the bottom surface of the accommodating section;

an operating plate shaft configured to support the operating plate rotatably to the sheet accommodating section;

a sector gear provided at one end of the operating plate shaft and configured to transmit drive power from the main body to the operating plate; and a pressing member capable of moving between a first location and a second location, the first location being a location where the pressing member comes in contact from above with the sheet loading plate at the lying down position, and the second location being a location where the pressing member retreats from the sheet loading plate to allow the sheet loading plate to be lifted up and down, wherein the pressing member is located at the first location when the sheet loading plate is positioned at the lying down position, and moves from the first location to the second location by rotation of the sector gear by a predetermined amount in a direction where the sheet loading plate is lifted up.

2. A sheet feeder according to claim 1, wherein the pressing member is arranged outside a wall located downstream of the sheet accommodating section in the sheet feed direction.

3. A sheet feeder according to claim 2, wherein by rotation of the sector gear, the pressing member is pushed by a side of the sector gear to move from the first location to the second location.

4. A sheet feeder according to claim 2, further comprising:

a link member arranged outside the wall between the pressing member and the sector gear and configured to swing by being pushed by rotation of the sector gear, wherein the pressing member is pushed by swing of the link member to move from the first location to the second location.

5. A sheet feeder according to claim 4, wherein the pressing member includes:

a first swing shaft which is formed at an upper end of the pressing member and which is swingably supported to extend horizontally;

a restricting portion formed at a swing end of the pressing member, which is located opposite to the first swing shaft, to abut on the sheet loading plate; and a first engaging portion protruding toward the link member from a part between the restricting portion and the first swing shaft, the link member includes:

a second swing shaft which is formed at one end of the link member and which is swingably supported on the sheet accommodating section to extend perpendicularly; and a second engaging portion formed at a swing end of the link member, which is located opposite to the second swing shaft, and horizontal swing of the link member about the second swing shaft as a swing pivot causes the second engaging portion to push the first engaging portion so that the pressing member swings vertically about the first swing shaft as a swing pivot to move from the first location to the second location.

6. A sheet feeder according to claim 4, wherein a sliding surface to allow the link member to swing away from the sector gear is formed on at least one of a part of the link member which is in contact with the sector gear and a part of the sector gear which is in contact with the link member.

7. A sheet feeder according to claim 6, wherein the sliding surface is in a hemispherical shape.

8. An image forming apparatus comprising:
a sheet feeder according to claim 1.

* * * * *